United States Patent [19]

Ilsemann

[11] 4,302,277

[45] Nov. 24, 1981

[54] LABELING DEVICE, PREFERABLY FOR CASSETTES OR THE LIKE

[76] Inventor: Heino Ilsemann, Am Wehkamp 3, 2800 Bremen, Fed. Rep. of Germany

[21] Appl. No.: 47,805

[22] Filed: Jun. 12, 1979

[30] Foreign Application Priority Data

| | | | |
|---|---|---|---|
| Jun. 14, 1978 | [DE] | Fed. Rep. of Germany | 2826035 |
| Aug. 11, 1978 | [DE] | Fed. Rep. of Germany | 2835211 |
| Jan. 19, 1979 | [DE] | Fed. Rep. of Germany | 2902050 |
| Jan. 19, 1979 | [DE] | Fed. Rep. of Germany | 2902104 |

[51] Int. Cl.[3] ..... B65C 9/00

[52] U.S. Cl. ..... 156/567; 118/264; 118/268; 118/602; 156/570; 271/160

[58] Field of Search ..... 156/350, 351, 356, 357, 156/571, 572, 578, 388; 118/260, 264, 266, 267, 268, 602; 271/160, 30 A

[56] References Cited

U.S. PATENT DOCUMENTS

| | | | |
|---|---|---|---|
| 805,098 | 11/1905 | Sage | 271/160 X |
| 1,832,501 | 11/1931 | Pittenger et al. | 156/388 |
| 2,083,042 | 6/1937 | Storck | 118/260 X |
| 2,651,429 | 9/1953 | Von Hofe et al. | 156/572 |
| 3,005,565 | 10/1961 | Doane et al. | 156/571 |
| 3,227,073 | 1/1966 | Reich | 118/264 X |
| 3,522,134 | 2/1980 | Von Hofe et al. | 156/571 |
| 3,527,458 | 9/1970 | Bond | 271/30 M |
| 4,007,684 | 2/1977 | Takano et al. | 118/602 X |

FOREIGN PATENT DOCUMENTS

| | | |
|---|---|---|
| 530482 | 7/1931 | Fed. Rep. of Germany . |
| 1187180 | 2/1965 | Fed. Rep. of Germany . |
| 1285942 | 12/1968 | Fed. Rep. of Germany . |
| 1811159 | 6/1970 | Fed. Rep. of Germany . |
| 1940934 | 9/1976 | Fed. Rep. of Germany . |
| 2714625 | 5/1978 | Fed. Rep. of Germany . |
| 1377511 | 9/1964 | France . |

*Primary Examiner*—David A. Simmons

*Attorney, Agent, or Firm*—Toren, McGeady & Stanger

[57] ABSTRACT

A device for labeling flat objects, such as compact cassettes, video cassettes or the like with a supply stacker for the transfer of label holder-arranged labels. The label holders are provided with vacuum impingeable suction bores for label transfers and with object recess- and label perforation-and border-matching beveled projections, plus a device for effective label adhesion. The device includes a radially-mobile arrangement of label holders on at least one step-by-step revolving rotary-run head. The holders move from the head to stationary functional stages, namely, a transfer stage, where the label is made to stick, and an applicator stage for applying labels to objects. A conveyor chain is provided for continually passing by the rotary-run head with object sliding cams. The applicator stage is equipped with a platform for lifting objects from the continuous-run conveyor chain above the level of the cams.

21 Claims, 9 Drawing Figures

V 86
92
94
90
98
96
P
106
36
112
104
100
102

LABELING DEVICE, PREFERABLY FOR CASSETTES OR THE LIKE

FIELD OF THE INVENTION

The invention relates to a device for labeling flat objects, such as compact cassettes, video cassettes or the like with a supply stacker for the transfer of label holder-arranged labels. The label holders are provided with vacuum impingeable suction bores for label transfers and with object recess— and label perforation-and border-matching beveled projections, plus a device for effective label adhesion.

Devices such as these serve to label flat objects, e.g., compact cassettes, video cassettes, audio tape recorder reels, or phonographic disks and similar objects, on which to apply supplied, stacked labels—after making them adhesive—in preselected patterns and alignments.

BACKGROUND OF THE PRESENT INVENTION

U.S. Pat. No. 2,676,726 describes such a device for applying flexible, perforated labels to objects or items, which have label perforation matching holes or recesses. With such processes, labels are removed from the label stacker by suction devices and deposited on a pile. A pin-equipped label holder uses the former for aligning the label. For making it adhesive, the label is heated and transferred to the labeling object by the label holder, whereby the label holder pin penetrates a matching opening in the object and, therefore, can apply the label exactly on the object.

The drawback of this process is not only that it is slowed up by the intermediate pile-up of labels but also that synthetic material-made, heat stick-on labels are quite expensive or must be provided in a completely separate, preliminary stage with hot-melt adhesive via heat stick-on paper labels. This also makes for a considerable cost factor.

In U.S. Pat. No. 2,764,408, a process and device for taking labels off a label stacker is described, where following the take-off of labels from the stack, the labels are deposited on a rotary-run head by nozzle-exit compressed air. In that patent, label holders comprise only non-positioning, label retaining adhesive surfaces. The particular drawback here is that labels cannot be applied in their exactly required position to subsequent-labeling objects, to which they are put by rotary-run head means.

In German design patent No. 1,884,257, an unclassified device for applying labels from a backing tape to an object by means of a rotary-run head, which is equipped with suction-and self-adhesive devices, is described. In this case, labels are taken off the tape by a radial motion away from the rotary-run head and toward said labels of the suction-and self-adhesive devices, whereby, on contacting the labels, the devices produce a suction effect. Then they retract by taking the label along with them. The rotary-run head then continues to rotate until the suction-and self-adhesive device which is now provided with a label, arrives on the conveyor path of labeling objects. There again the suction-and self-adhesive device moves radially outward toward the labeling object, presses the matching label against it—whereby the suction vacuum is turned off—and subsequently retracts. The drawback of this device is that adhesive labels must be used, which previously must be applied to a tape. Aside from that, with a device according to German design patent No. 1,884,257, no exact positioning of labels on labeling objects is possible.

The object of the invention is to produce a classified type of device, which allows for high speed-operated, accurate and clean labeling by means of stacker-removable, low-cost labels.

SUMMARY OF THE INVENTION

This problem is solved according to the invention by a radially-mobile arrangement of label holders on at least one step-by-step revolving rotary-run head, with the holders moving from the head to stationary functional stages, namely a transfer stage, where the label is made to stick, and an applicator stage for applying labels to objects; by providing a conveyor chain continually passing by the rotary-run head with object sliding cams; and by equipping the applicator stage with a platform for lifting objects from the continuous-run conveyor chain above the level of the cams.

With a device according to the invention then, labels are stepwise conveyed from the transfer stage and/or supply stacker provided in it to the applicator stage by at least one radially mobile, label holder-equipped, rotary-run head, and on each rotary-run head step the labels are subjected to at least the following functional stages; takeover of labels by transfer staged label holders; making labels stick in the applicator stage; lift-off of objects, specifically cassettes, from said continuous-run conveyor chain for applying labels to them by a radial approach of respective label holder to the object and by break-off of the suction vacuum.

A particularly preferred embodiment of the invention provides for the bilateral arrangement on said conveyor chain of identical, mirror-inverted, synchronously operating, rotary-run heads with matching peripheral spaced stages. This simultaneous bilateral labeling of objects, specifically of compact cassettes, practically doubles the total labeling speed.

A further provision according to the invention is that the applicator stage is equipped with a horizontal type of vertical-axially rotatable, bonding-liquid-provided, applicator roll for applying bonding liquid to labels.

Because thereby the labels are made to stick by a horizontally laid movable, bonding-liquid-provided, applicator roll, a clean application of bonding liquid to a label to be attached to an object can be made, because the bonding liquid cannot runoff in an assymmetrical way as would be the case, of course, with a vertically supported roll. Suitable bonding liquids to be used include various types of known liquids adapted for the purpose such as solvents as perchloroethylene, which on the labeling of synthetic material-made, compact cassettes dissolve the compact cassette surface and thereby assure an effective bond between cassette and label. Also known suitable adhesives of various types, e.g. cold glue but also hot-melt adhesives can be applied to labels to establish a firm bond between labeling object and label. Labels can be provided also with a type of adhesive, which can be removed later, e.g., by the buyer of the labeling object.

A further preferred development of the device according to the invention provides also for the covering of the applicator roll with cloth. Though it is within the scope of the object of the invention to improve bonding liquid applications to the label by equipping the applicator roll with channels or grooves, an extremely clean type of bonding liquid application to labels is obtained by providing the applicator roll with a cloth covering.

This way the wetting of labels can be optimized. Further preferred developments provide for sheathing the applicator roll in a mantle or provide it with a longitudinal clamping device, into which a rectangular cloth piece is bilaterally clamped, where the advantage of the latter improvement is that it cannot be shifted. In order to prevent such a clamping device from impairing the wetting effect on labels, a further improvement of the device according to the invention provides for the applicator to be rolled off in such a reversible way that the clamping device is kept away from the label surface.

Another extremely preferred improvement of the invention provides for the applicator roll to roll around in a bonding liquid bath beneath it in an axial-revolving, vertical motion imparting way, and for a vertical distance from the applicator roll axis to the lower surface of the label-holder-held label to be at least 30 mm. This way, a sufficient wetting of a sufficiently large applicator roll circumferential surface is obtained, so that the entire label can be uniformly supplied with bonding liquid. To remove any excess bonding liquid from the applicator roll—otherwise such excess bonding liquid would run off the label and leave an ugly border on the lower edge of the object applied label—another improvement provides for arranging a scraper roll in contact with the applicator roll. Tests have shown that with an exactly cylindrical, applicator roll label longitudinal applications are not of a completely uniform type; accordingly, a preferred improvement of the invention provides for the uniform distribution of label-applied liquid by a slightly bomb shaped design.

The distribution of bonding liquid on labels to be applied to cassettes or the like can still be further improved by giving the device according to the invention a different design, which is characterized by equipping the applicator stage, in which the labels are made to stick, with a label holder facing, substantially vertically arranged moistening-clothed moistener plate, into which frontal surface interfacing with the moistening cloth near the upper plate edge a plurality of moistening channels is discharged, which can be impinged by metering from a central pump reservoir with a label-sticking bonding liquid; and further characterized by arranging below the moistening plate a basin for collecting excess bonding liquid, which has a pump connection via a return pipe. A particularly useful feature is to have the moistening cloth dip in the basin contained bonding liquid because the wick effect produced this way assures a particularly uniform moistening of the entire moistening cloth and thus also that of the label to be wetted.

A particularly optimized transfer of labels from supply stacker to label holder is produced with an embodiment of the device according to the invention, which is characterized by a trough-line guide in the transfer stage arranged substantially horizontally radially to the rotary-run head for picking up the supply stacker of substantially vertical-arranged labels, with said trough-line guide's cross-section substantially matching that of the labels, and which has at its forward end facing the label holder and/or rotary-run head at least two opposite fitting edges for retaining the supply stacker; a pressure plate arranged in said trough-line guide in a sliding way, which pushes the labels in the direction of the fitting edges; and a brake device for pressure relief of the presser plate and that way of the label supply stacker on approaching the label holder during label transfer from supply stacker to label holder. This embodiment of the device according to the invention effectuates a trouble free, unpressurized transfer of labels from supply stacker to label holder.

A problem, which generally has developed with prior art devices is that these dimensionally accurate-punched out labels, which are located in the label supply stacker, must be preprinted. In addition, on changing the labeling of objects or cassettes in each case, the labels must be removed from the label stacker, and new, differently printed labels must be inserted, which, too, means a considerable waste of time and, in that way, a reduction in device production output. To avoid these drawbacks and to supply objects, such as cassettes, with data and advertising messages, a special embodiment of a device according to the invention provides that aside from the conveyor claim at least one printer stage is incorporated.

Because, with the above embodiment, the labels are printed directly on cassettes a better type of print and more colorful-improved label is produced, the advantage of which particularly with a label color background is obvious. If, according to a provision of the invention, labels applied to both sides of an object are simultaneously printed, then the requirement of opposed support is eliminated, which would be required because of the unstable mounting of objects in the conveyor route when single-sided print impressions are made. A further preferred embodiment according to the invention provides for a continuous printout of labels, where specifically labels can be printed by means of a vertically staged, cylindrical printing head, which rolls off a continuous run of labeled objects.

Further provisions made include that labels can be multi-color, printed by means of series-staged printouts and/or that printed labels are dried under ultraviolet light.

If requirements call for a discontinuous type of object printing, i.e., with a process, where objects are stationary, then, according to a preferred embodiment of the device according to the invention on a printer stage and/or stages, a respective platform lift for lifting objects off the continuous-run conveyor chain is (are) arranged, where advantageously each printer stage has a horizontally arranged printing roller for vertical roll-offs.

The device according to the invention assures a totally uninterrupted labeling of objects, e.g., where, on labeling compact cassettes under conditions of fixing and/or exact positioning of both cassettes and labels, a continuous run of 140 cassettes per minute and more can be expected, while prior-art label fixing equipped labeling devices reach only a run of 70 cassettes per minute, and classified types of labeling devices without any fixing reach a run of about 100 cassettes per minute; this progress is produced, e.g., by avoiding the time wasting and expensive takeoff of labels from the backing tape, where additionally labels do have to go through a pre-application stage.

Further features and advantages of the invention are given in claims and the following description, in which exemplified embodiments are explained in more detail with reference to the accompanying schematic drawings.

DESCRIPTION OF THE PREFERRED EMBODIMENTS

Figure 1:
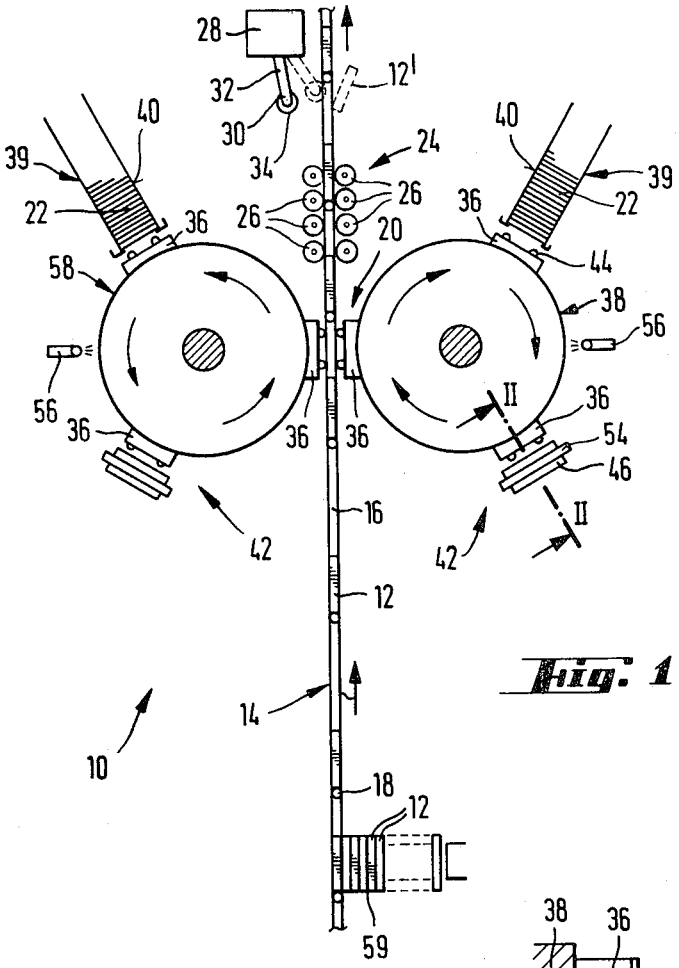
FIG. 1 shows a schematic top view of a first exemplified embodiment of the labeling device according to the invention.

The labeling device shown in FIG. 1, which serves to label cassette compacts 12, has a linear conveyor path 14 for conveying cassettes 12. The latter are conveyed along conveyor path 14 by means of a chain 16 and cams 18 projecting from said chain. On conveying the cassettes, they run through a depositer stage 20, in which cassettes 12 on both sides are provided with labels 22. Located behind depositor stage 20 and parallel to conveyor path 14 of cassettes 12 is a stage 24 with pressure rollers 26 for pressing labels 22 against cassettes 12. Set adjacent to cassette 12-conveyor path 14 and further downstream, there is a device 28 for ejecting cassettes 12 from their normal conveyor path 14, whereby the device 28 is equipped with an ejector roll 34 at the end 30 of a pivotal lever 32 for ejecting the cassettes from their conveyor path 14. Both the ejecting position of ejector roll 34 and a just-ejected cassette 12' are shown in FIG. 1 by broken lines.

At the level of depositor stage 20 on both sides of conveyor path 14 for cassettes 12, rotary-run heads 38,58 each equipped with three label holders 36 for applying labels 22 to cassettes 12 are arranged. Thereby, label holders 36 are symmetrically attached around rotary-run heads 38,58 at respective angular spacings of 120°. Accordingly, spaced around rotary-run heads 38,58—at an angular distance of 120° from depositor stage 20—there are a respective transfer stage 39 with a label supply stacker 40, and an applicator stage 42 for making labels 22 stick by applying a bonding liquid, such as a solvent for etching the cassette surface, or an adhesive. Label holders themselves substantially match label holders or transfer devices as described in U.S. Pat. No. 2,676,726, whereby label holders 36 according to the rectangular shape of labels 22 are provided with outer limit projections. Label holders 36 are equipped with pinheads 44, which serve to exactly position the labels on label holders and are retractable—via spring loaded means (not shown)—in the label holders for effecting the application of bonding liquid.

Figure 2:
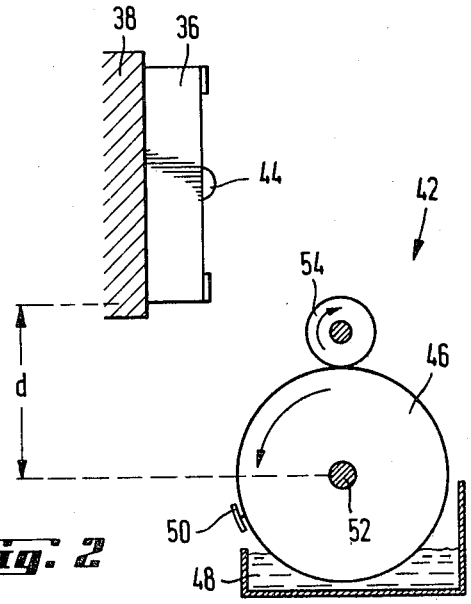
FIG. 2 a cut along line II—II of FIG. 2 through a label holder, and an applicator roll for applying a bonding liquid at a position prior to and/or after a bonding liquid application.

With the exemplified embodiment shown in FIGS. 1 and 2, the applicator stage 42 substantially comprises an applicator roll 46 for applying bonding liquid from a bonding liquid bath 48 to a label holder 36-held label 22. As specified, the bonding liquid, which effects an adhesive bond with a cassette, for better results comprises a cassette surface etching solvent, e.g., perchloroethylene, also known as tetrachloroethylene.

The applicator roll 46 is provided with a cloth piece, which is clamped into a clamping device 50. Axle 52 of applicator roll 46 is horizontally arranged. At its upper peripheral point, applicator roll 46 interconnects with a matchingly fitted scraper roll 54, e.g., made of metal. A key factor is that the vertical distance from applicator roll 46-axle 52 to the lower edge of label holder-retained label 22 is at least 30 mm, so that applicator roll 46, on its roll-off over label-holder-held label 22—whereby the bonding liquid, in this case the solvent, is transferred to label 22—to a sufficient measure can revolve in bonding liquid and/or the solvent bath for a good soaking. A photocell 56-arrangement is provided off rotary-run head 38 at the level of label holder 36-held labels, which is in electrical connection with device 28 so that, in case there is no label 22 present on a by-passing label holder 36, the respective cassette 12' can be ejected by ejector roll 34 from the cassette 12-conveyor path.

The operation of the device described thus far according to the exemplified embodiment shown in FIGS. 1 and 2 is as follows:

With switched-in labeling device 10, cassettes 12 are pushed out (the standard way one after another by cassette stacker 59) into their conveyor path above conveyor chain 16, and respectively are picked up by cams 18 on conveyor chain 16, and then transported to depositor stage 20. Thereby, conveyor chain 16 makes a continual run. Simultaneously, a label holder 36, staged in front of label stacker 40 with its suction devices or openings (not shown) pulls in a label 22, whereby the latter is positioned by above indicated pinheads 44 and enclosure projections, and where the pinheads 44 are rectracted into label holder 36 through recesses in label 22. Subsequently, label 22 is locked into label holder 36 by means of a suction device (not shown).

Following the pickup of a label 22 from supply stacker 40, which is timed during the idle position of rotary-run head 38, the latter starts a 120° turn until label holder 36, which as described above has just picked up a label 22, arrives at applicator stage 42. On a pass in front of photocell arrangement 56, the latter checks on whether a label 22 is held by the passing label holder. On using bright-colored, specifically white labels, the label holder 36 shows a dark area, so that photocell arrangement 56 on picking up a passing dark area puts out a signal to device 28, by which the latter is switched in after a preset delay for pushing ejector roll 34 into the cassette conveyor path 14, whereby the delay just matches the total time elapsed from the passage of respective cassette holder 36 at photocell arrangement 56 to depositor stage 20 and the further transport of a cassette 12, which is located simultaneously with respective cassette holder 36 in depositor stage 20, and their transport to ejector roll 34. Accordingly, only that cassette 12' is ejected, on which there is no label 22 on at least one side, because no label was present in label holder 36 for deposit.

On passing photocell arrangement 56 the label holder 36 reaches applicator stage 42. In this position, rotary-run head 38 again is stopped. If a label 22 is located in label holder 36, then applicator roll 46 is moved upward by a simultaneous radial projection of label holder 36 while retracting pinheads 44 from rotary-run head 38, whereby applicator roll 46 turns in a direction as shown by the arrow in FIG. 2. Thereby applicator roll 46 picks up bonding liquid, in this case solvent, from liquid bath 48. Excess solvent is held back by scraper roll 54, said roll touching applicator roll 46. Subsequently, that part of applicator roll 46, which is sufficiently soaked with solvent, is carried and/or rolled over label 22 in label holder 36 and delivers a sufficient amount of solvent to said label 22.

Subsequently, rotary-run head 38 is moved on by one stage, i.e., by 120°, and just moistened label 22 in label holder 36 is moved to depositor stage 20. There simultaneously, as already indicated above, a cassette is lifted off conveyor chain 16 by a platform lift and kept on the platform while conveyor chain 16 and respective cam 18 carried along beneath cassette 12 are run through. Moistened label 22 is pressed against cassette 12 by the radially projecting motion of label holder 36. The same way a matching label 22 is pressed against the other side of cassette 12 by opposite label holder 36, and subsequently both label holders are again retracted. Rotary-run head 38 then is turned around again for one step while, simultaneously, cassette 12 having just been provided with labels 22 is carried off the platform lift by the following cassette, whereby the following cassette on arrival at depositor stage 20 is again lifted up, while cam 18 having carried it along to this point runs through beneath it and picks up cassette 12, while meanwhile having been dropped off conveyor chain 16 is now supplied with labels.

Bilaterally label 22-supplied cassette 12 then is carried through to stage 24, in which pressure roller 26 firmly presses labels 22 against the cassette 12. The latter, carried past device 28, which is not activated because the present cassette has been bilaterally equipped with labels, can be further manipulated, e.g., for repeated stacking and packaging or the like.

Figure 3:
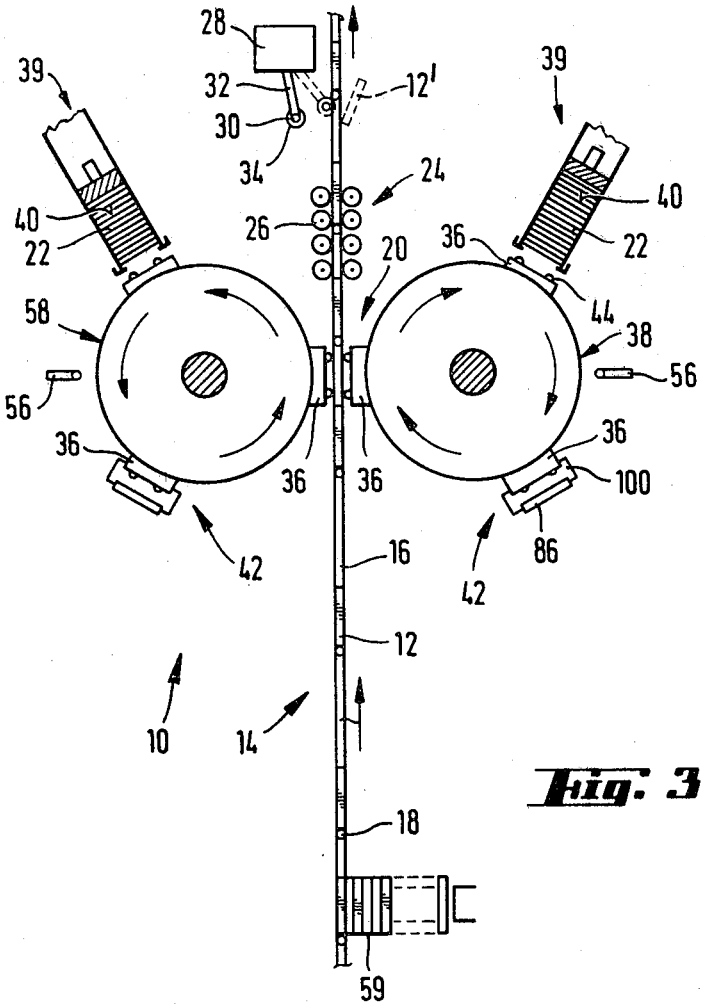
FIG. 3 a modified exemplified embodiment of the labeling device according to the invention in a top view.
Figure 4:
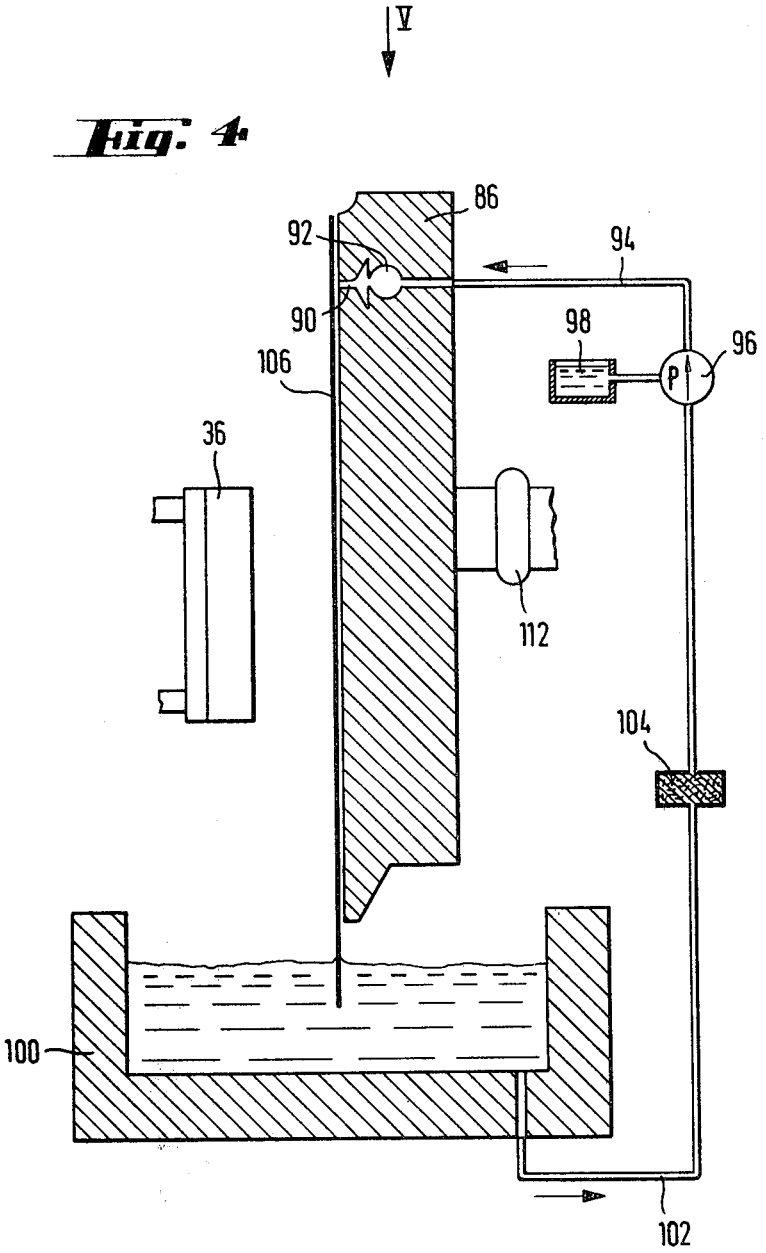
FIG. 4 an applicator stage of the exemplified embodiment shown in FIG. 3 in a partial cut through a lateral view.
Figure 5:
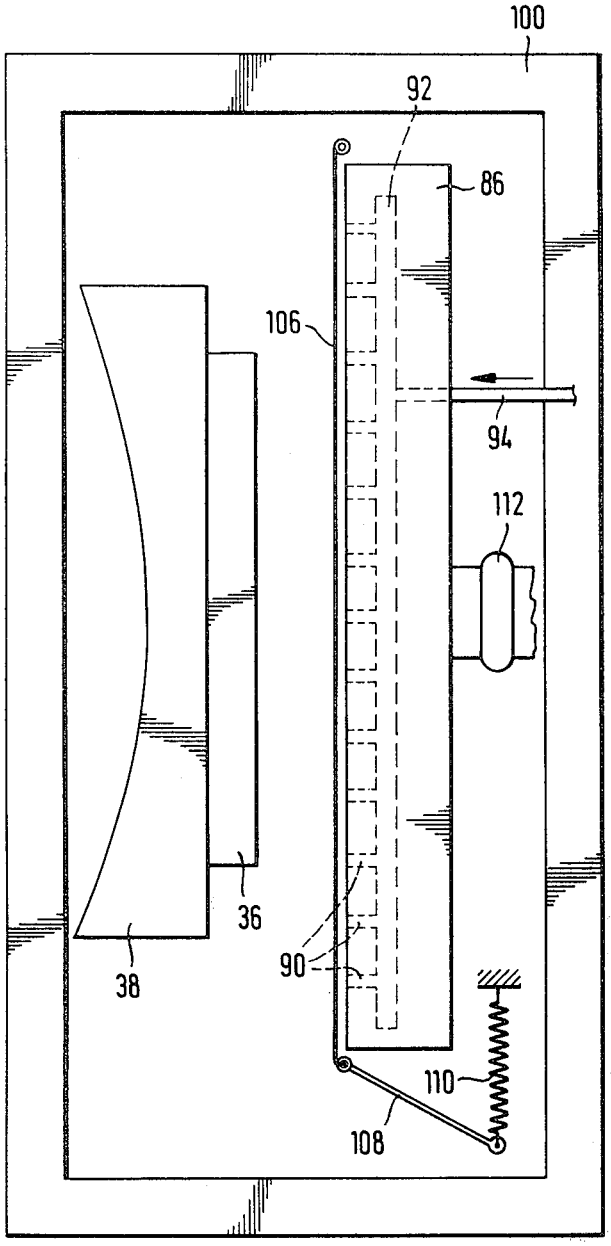
FIG. 5 an applicator stage of FIG. 4 in a top view.

The exemplified embodiment shown in FIGS. 3 thru 5 has an applicator stage 42 of different design. In this case, applicator stage 42, as schematized in FIG. 3 and detailed in FIGS. 4 and 5, has a vertically arranged moistener plate 86 facing a label holder 36 of rotary-run head 38, beneath which plate a basin 100 for trapping excess bonding liquid is arranged. As shown in more detail in FIGS. 4 and 5, moistener plate 86 is equipped with a plurality of moistener channels 90, which discharge in its frontal side, and which—see FIG. 5—are arranged in a horizontal row and connected to a supply line 92. The latter again, as shown in FIG. 4, is in communication with a reservoir 98 for bonding liquid via feeder line 94 and a pump 96, preferably a fine-and-exact metering diaphragm pump. Furthermore, FIG. 4 shows that beneath moistener plate 86 and/or label holder 36, a basin 100 for trapping excess bonding liquid is arranged. Basin 100 again is connected to a pump 96 via a return line 102 with a filter 104, in which from the back flow of excess bonding liquid floating particles, specifically those rubbed off from moistened label and moistener cloth 106 components still to be discussed, are filtered out.

The important thing to remember is that the front of moistener plate 86 carries moistener cloth 106, which—what is considered to be a key factor of the invention—dips into basin 100. From FIG. 5 it is evident how moistener cloth 106 is clamped onto the upper vertical length edge of moistener plate 86, and is clamped to a hingeable ridge on the opposite vertical length edge (shown below in FIG. 5) via a spring 110 loaded lever 108. This arrangement is used to constantly tighten moistener cloth 106 over the frontal surface of moistener plate 86. A provision can be made, too, of course, for clamping in the moistener cloth on horizontal devices, however, the embodiment shown has been proven as particularly useful because this way the moistener cloth can be dipped into the bonding liquid in basin 100. As shown in FIG. 5, of course, also the upper clamping device for moistener cloth 106 can be developed as feed roll so that not only a constant reclamping but replacing the moistener cloth directly in front of moistener plate 86 is possible.

A dipping of moistener cloth 106 into the bonding liquid in basin 100 is particularly useful because this way a wick effect is produced, by which, in connection with a well-metered impingement of moistener channels 90 with bonding liquid, a uniform wetting and moistening of moistener cloth 106 is assured. This prevents excess adhesive and/or excess bonder liquid from getting on the label in label holder 36, so that an extremely clean labeling process is assured.

To be noted is that moistener plate 86 has a floating mounting 112, whereby this support can be effected in any manner known to experts in the field, e.g., by spring anchored, relatively wide-bore, through bolts, or ball-and-socket or cardan joints.

Also to be noted is that the moistener plate 86 itself can be pneumatically or hydraulically movable in the direction of and away from label holder 36 so that with this exemplified embodiment no label holder 36-slider device is required for bringing the label holder-held label in contact with moistener cloth 106.

A further note: Diaphragm pump 96 preferably is controlled as a function of output, i.e., in the machine idling position only very little liquid per unit time is delivered through moistener channels 90, just enough—in connection with the described wick effect—to keep moistener cloth 106 moistened to the extent required for an initial labeling pass. The metering of bonding liquid then can be controlled as a function of rotary-run head (38,58) rpm, whereby specifically also a discontinuously-timed impinging of moistener channels 90 with bonding liquid, that is, upon each stop of rotary-run heads, is feasible.

Figure 6:
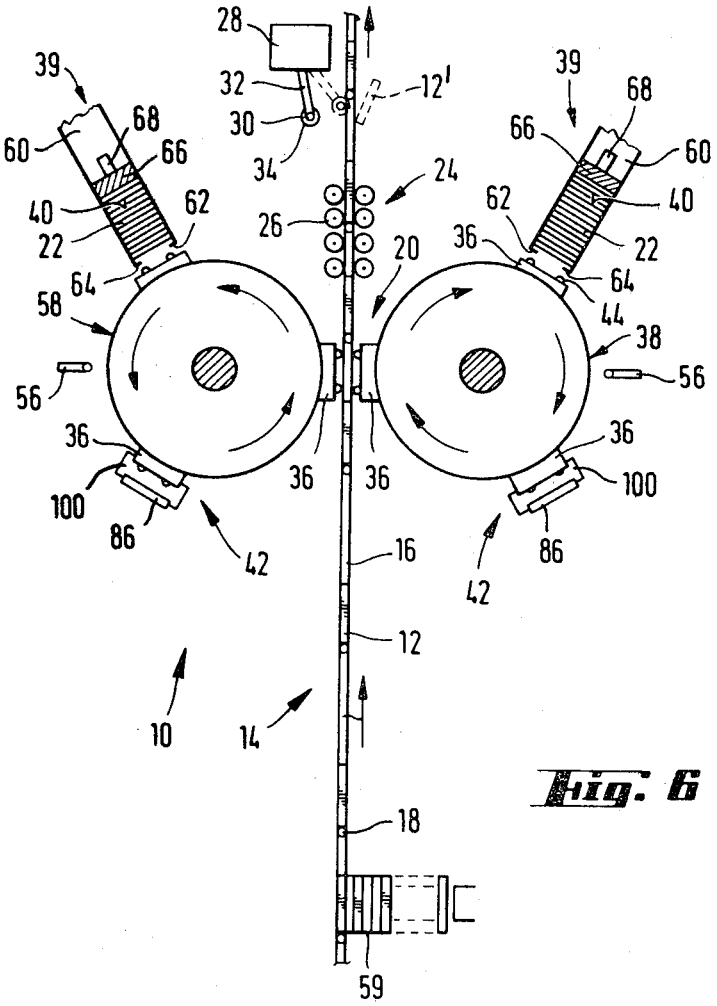
FIG. 6 a further exemplified embodiment of the labeling device according to the invention in a top view.
Figure 7:
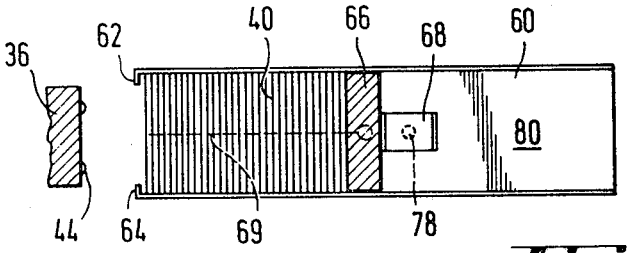
FIG. 7 a transfer stage of the exemplified embodiment shown in FIG. 6 of the labeling device according to the invention in a top view.
Figure 8:
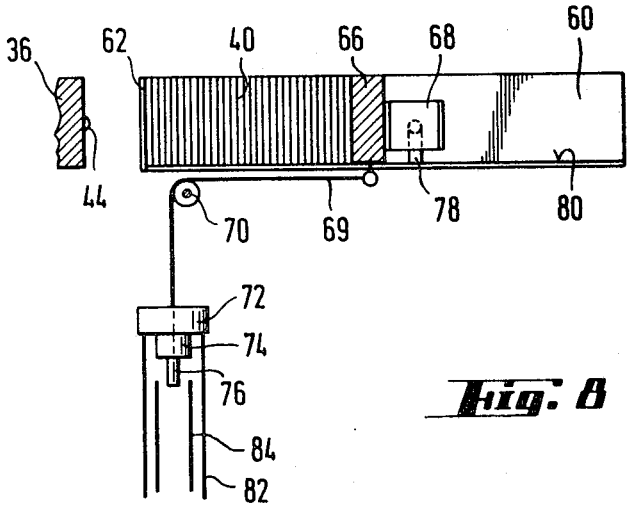
FIG. 8 a transfer stage of FIG. 7 in a partial cut through a lateral view as in FIG. 7.

With the exemplified embodiment of the invention illustrated in FIGS. 6 thru 8, transfer stage 39 has a trough-line guide 60, which substantially runs horizontally and radially to rotary-run head 38 and/or 58 and which at its end facing the rotary-run head 38—hereafter to be referred to exclusively as such—is equipped with two vertical guide edges 62,64. Supply stacker 40, which comprises vertically arranged single labels 22, is pressed in the direction of label holder 36 and/or guide edges 62,64 by presser plate 66. FIG. 6 at this point shows presser plate 66 being associated with a solid-connected pneumatic piston cylinder unit 68.

As is evident from FIGS. 7 and 8, presser plate 66 is loaded by single weights (72,74,76) via a rope 69 run over guide pulley 70, so that supply stacker 40 is pressed against guide edges 62,64. The pneumatic-operated piston cylinder unit 68, which is solid-connected to presser plate 66, as shown in FIG. 8, is equipped with brake pin 78, which can be pressed against the horizontal rail surface 80 of presser plate 66 and, that way, trough-line guide 60. As further shown in FIG. 8, single weights 72 and 74 being loosely hung up on rope 69 can be supported by two concentric tubes 82,84, which differing from each other in diameter and height, are located beneath weights 72, 74, 76.

The transfer stage shown in more detail in FIGS. 7 and 8 operates as follows:

Normally brake pin 78 is inactive, i.e., presser plate 66 with respect to its feed in the direction of label holder 36 is not braked. In this state, weights-loaded presser plate 66 pushes labels against guide edges 62,64. If now pneumatic-controlled label holder 36 is driven from its position shown in FIGS. 7 and 8 to the right, namely adjacent to label stacker 40, then said holder pushes the latter to the right rear with a simultaneous minor displacement of presser plate 66. In this position now, the label next to be taken off label holder 36 is lifted off guide edges 62,64. In this position then, presser plate 66 is arrested by pulling out brake pin 78 for a lateral engagement of rail surface 80 of trough-line guide 60. This way the label out front can be sucked against label holder 36 in an unpressurized way, without pushing it against guide edges 62,64 so that the transfer process is decisively improved.

Because of the arrangement of single weights 72,74, and 76 shown in FIG. 8, it is assured also that with increasing presser plate 66-feed, that is, reduced height and/or length of label stacker 40, an ever stronger unloading of presser plate 66 is effective so that label stacker 40 labels are pressed against forward guide edges 62, 64 only with an absolutely required amount of pressure.

Figure 9:
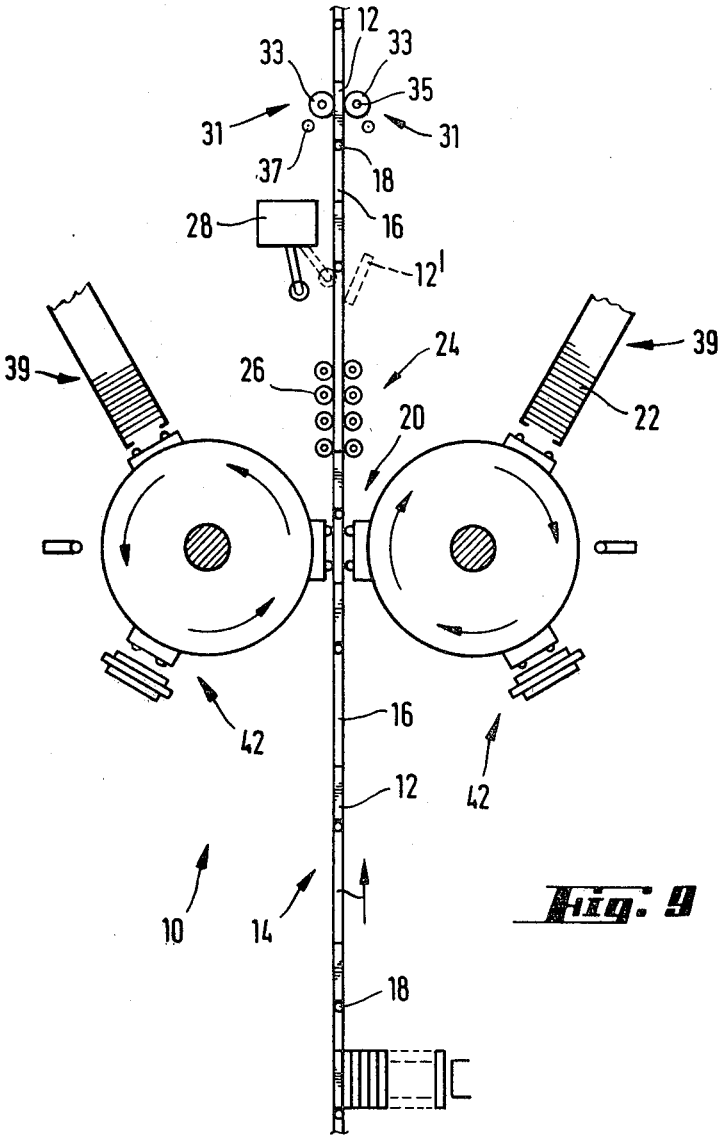
FIG. 9 a final exemplified embodiment of the labeling device according to the invention in a top view.

With the exemplified embodiment of the invention as schematized in FIG. 9 aside from a conveyor path 14 for cassette compacts 12, there are printer stages 31 arranged on both sides of said conveyor path 14. Said the printer stages 31 serve to print cassette 12-applied labels 22, e.g., which can be completely white or show a color background. Respective printer stages 31 substantially comprise one vertically arranged printing roll 33, i.e., having a vertically aligned axis. Each printing roll is provided with color by an inker 37, whereby the latter is of a prior art type and, therefore, is only symbolically indicated in the drawing.

If now, a label 22-provided cassette 12 with its forward end hits printer stage 31, then printing rolls are bilaterally pressed against cassette 12, and on a run of cassette 12 through printer stage 31 roll off respective labels 22 on cassette 12 and, in this manner, print labels with a provided print image. Following a run of cassette 12 through printer stage 31, printing rolls 33 are again withdrawn from conveyor path 14 for cassettes 12 and reset into their initial position suitable for the start of the next printout process on the next cassette 12. This way, by using the device according to the invention, in a time saving and simple manner, labels 22 and cassettes 12 can be printed—directly after the depositor staging of labels 22 on cassettes 12—in a continual operation.

The features of the invention disclosed in above description, drawing, and claims can be the key—singly or in any given combination—for implementing it in its various embodiments.

I claim:

1. In a device for the labeling of tape cassettes, with a conveyor conveying the cassettes linearly on edge, with a supply magazine from which the cassettes are guided to the conveyor, and devices for application of the labels arranged opposite each other on both sides of the conveyor, the improvement comprising:

each label application device having radially moving label holders (36) rotating rhythmically about a vertical axis, with vertical suction surfaces, and two pinheads (44) penetrating the suction surfaces, retractable against spring tension radially behind the suction surface, and adjusted to recesses of the cassette and perforations of the labels, a supply stacker (40), said pinheads being movable with respect to said supply stacker, an applicator stage (42) for adhesive liquid and depositor stages (20); the conveyor being constructed as a continuously rotating conveyor chain (16) having cams (18) for inserting the cassettes; and an elevating platform being arranged in the depositor stages (20) which lifts the cassettes via the cams (18) into the operating range of the label holders (36).

2. A device according to claim 1, including a trough-line guide (60), the supply stacker (40) being arranged essentially horizontally inside said trough-line guide (60) whose cross-section corresponds essentially to those of the vertically arranged individual labels and which at its output end, facing the rhythmically rotating, radially moving label holders (36) has at least two opposite contact edges to hold the label stack; a weighted presser plate (66) being arranged inside the trough-line guide at the end of the supply stacker located opposite the output end, which presser plate presses the labels in the direction towards the contact edges and is longitudinally slidably mounted in the trough-line guide; a number of individual weights (72), (74), (76) acting on the presser plate via a cord, and said weights being successively supportable as the label stacker (40) becomes smaller; and a braking device (68), (78) being provided for unloading of the presser plate (66) and, consequently, the supply stacker (40) during the label delivery.

3. A device according to claim 2, including concentric tubes of different height (82), (84), and wherein the weights (72), (74), (76) have different diameters, are loosely arranged on a cord connected with the presser plate (66) via at least one deflector pulley (70), and during increasing advancement of the presser plate the weights come in contact one after the other on the peripheral edges of the concentric tubes.

4. A device according to claim 2 or 3, wherein the braking device for the presser plate (66) has a pressure ledge stretching over the entire path of advancement of the presser plate, and a stationary piston cylinder unit which presses the presser plate via the pressure ledge during the label output against a rail surface (80) of the trough-line guide (60).

5. A device according to claim 2 or 3, wherein the braking device for the presser plate (66) has a pneumatic piston cylinder unit (68) rigidly connected with the presser plate and slidable with same which, during actuation, presses a brake pin (78) against a presser plate rail surface (80).

6. A device according to claim 4 or 5, wherein the piston cylinder unit (68) is pneumatically operable.

7. A device according to claim 1, wherein the applicator stage (42) for the adhesive liquid has a horizontally located applicator roll (46) to apply the adhesive liquid onto the labels (22), held in the label holders (36), said applicator roll being provided with adhesive liquid and is rotatable about its vertically movable axis.

8. A device according to claim 7, wherein the applicator roll (46) is covered with cloth.

9. A device according to claim 8, wherein the applicator roll (46) is covered with a stocking.

10. A device according to claim 8, wherein the applicator roll (46) is provided with a clamping device (50), extending over its length, in which at both sides a rectangular piece of cloth is stretched.

11. A device according to claim 10, wherein the applicator roll (46) is reversably rollable in such a way that the clamping device (50) is kept away from the label surface.

12. A device according to claim 7 or 8, wherein the applicator roll (46) rolls in an adhesive liquid bath (48), located below the applicator roll and vertically movable with its axis; and that the vertical distance (d) of the axis of the applicator roll (46) from the lower edge of a label (22), located in a label holder (36), is at least 30 mm.

13. A device according to claim 7 or 8, wherein a scraper roll (54) is arranged in contact with the applicator roll (46).

14. A device according to claim 7 or 8, wherein the applicator roll (46) is constructed slightly concave.

15. A device according to claim 1, wherein the applicator stage (42) for adhesive liquid has a moistener plate (86) which can be brought in contact with the label to be moistened with adhesive liquid, the moistener plate carrying at the frontal surface, facing towards the label to be moistened, a moistener cloth (106) which is acted upon with adhesive liquid from a central reservoir from a horizontal row of moistener channels (90) opening exclusively near the upper edge of the plate into the frontal surface of the vertically arranged moistener plate (86) carrying the moistener cloth (106); below the moistener plate (86) a basin (100) to receive excess adhesive liquid is arranged which is in connection with the pump (196) via a return line (102); and that the moistener cloth (106) immerses into the adhesive liquid in the basin (100).

16. A device according to claim 15, wherein between the basin (100) and the pump (96) a filter (104) is connected.

17. A device according to claim 15 or 16, wherein the moistener cloth (106) is stretched close to the vertical longitudinal edges of the moistener plate (86).

18. A device according to claim 17, wherein the moistener cloth (106) is firmly stretched close to a vertical longitudinal edge of the moistener plate (86) and is connected close to the opposite longitudinal edge with a clamping device (108), (110).

19. A device according to claim 18, wherein the clamping device (108), (110) has at least one lever (108) permanently under spring tension (110).

20. A device according to claim 15 or 16, wherein the moistener plate (86) is floatably supported and steered in the direction towards the label holder (36) and is constructed horizontally slidable with respect to the normal direction to the plane of the moistener cloth (106), wherein the basin (1007) extends below the entire sliding range of the moistener plate (86).

21. A device according to claim 20, wherein the moistener plate (86) is pneumatically movable.

* * * * *